US005879619A

United States Patent [19]

Ueda

[11] Patent Number: 5,879,619

[45] Date of Patent: Mar. 9, 1999

[54] HYDROGEN SULFIDE CORROSION RESISTANT HIGH-CR AND HIGH-NI ALLOYS

[75] Inventor: Masakatsu Ueda, Shikigun, Japan

[73] Assignee: Sumitomo Metal Industries, Ltd., Osaka, Japan

[21] Appl. No.: 836,108

[22] PCT Filed: Jun. 17, 1996

[86] PCT No.: PCT/JP96/01672

§ 371 Date: May 5, 1997

§ 102(e) Date: May 5, 1997

[87] PCT Pub. No.: WO97/48830

PCT Pub. Date: Dec. 24, 1997

[51] Int. Cl.[6] ..... C22C 30/02; C22C 38/02

[52] U.S. Cl. ..... 420/582; 420/34; 420/40; 420/41; 148/142

[58] Field of Search ..... 420/582, 34, 40, 420/41; 148/419, 442, 331, 332

[56] References Cited

U.S. PATENT DOCUMENTS

| | | | |
|---|---|---|---|
| 4,201,575 | 5/1980 | Henthorne et al. | 420/582 |
| 4,400,209 | 8/1983 | Kudo et al. | 420/443 |
| 4,400,210 | 8/1983 | Kudo et al. | 420/443 |
| 4,816,218 | 3/1989 | Mankins et al. | 420/582 |
| 4,824,638 | 4/1989 | Culling | 420/582 |
| 4,840,768 | 6/1989 | Domian et al. | 420/582 |
| 4,876,065 | 10/1989 | Rockel et al. | 420/582 |
| 5,011,659 | 4/1991 | Culling | 420/582 |

FOREIGN PATENT DOCUMENTS

| | | |
|---|---|---|
| 57-131340 | 8/1982 | Japan . |
| 57-134544 | 8/1982 | Japan . |
| 57-134545 | 8/1982 | Japan . |
| 3-104842 | 5/1991 | Japan . |
| 5-148592 | 6/1993 | Japan . |
| 8-109444 | 4/1996 | Japan . |

*Primary Examiner*—Margery Phipps
*Attorney, Agent, or Firm*—Burns, Doane, Swecker & Mathis, LLP

[57] ABSTRACT

A high-Cr and high-Ni alloy of the invention comprises the following chemical composition and has excellent corrosion resistance to hydrogen sulfide in an environment where a partial pressure of hydrogen sulfide is about 1 atm., or below and the temperature is about 150° C. The alloy is free of any expensive Mo and W and is thus inexpensive, with the attendant feature that mass production is possible: Si: 0.05–1.0%, Mn: 0.1–1.5%, Cr: 20–30%, Ni: 20–40%, sol. Al: 0.01–0.3%, Cu: 0.5–5.0%, REM: 0–0.10%, Y: 0–0.20%, Mg: 0–0.10%, Ca: 0–0.10%, and balance: Fe and incidental impurities, provided that C, P and S in the incidental impurity are, respectively, 0.05% or below, 0.03% or below and 0.01% or below. As set out above, each of REM, Y, Mg and Ca do not have to be added at all. If these elements are used, one or more of REM, Y, Mg and Ca are added. Preferable ranges of the contents of these elements when added are such that REM: 0.001–0.10%, Y: 0.001–0.20%, Mg: 0.001–0.10%, and Ca: 0.001–0.10%.

18 Claims, No Drawings

HYDROGEN SULFIDE CORROSION RESISTANT HIGH-CR AND HIGH-NI ALLOYS

TECHNICAL FIELD

This invention relates to austenitic high-Cr and high-Ni alloys and more particularly, to high-Cr and high-Ni alloys which exhibit a good corrosion resistance when placed in an aqueous solution having a relatively low hydrogen sulfide concentration at a partial pressure of hydrogen sulfide gas of 1 atm., or below.

TECHNICAL BACKGROUND

Hydrogen sulfide contained in liquids, such as petroleum, is highly corrosive against alloys. Accordingly, the alloys used in liquids containing hydrogen sulfide should have a good corrosion resistance to hydrogen sulfide. The examples of alloys which are employed in environments where they are in contact with hydrogen sulfide-containing liquids include drill pipes, pipes for flow lines from oil wells, oil country tubular goods for oil and natural gas wells, plate members for natural steam power stations, plate members for installation for desulfurization from exhaust gases, and the like. Especially, drilling of oil wells, exploitation and production of natural gas involve corrosive environments which are severe. For an index indicating the corrosive environment of hydrogen sulfide, the usual practice is to use a partial pressure of hydrogen sulfide in a gas phase. This is because the concentration of hydrogen sulfide in an aqueous solution is substantially proportional to the partial pressure of hydrogen sulfide in a gas phase, thus enabling one to simply express the degree of influence on alloys. With production pipes for oil wells, it has been frequently experienced that alloys are exposed to severe environmental conditions such as a partial pressure of hydrogen sulfide of about 10 atm., and a temperature of about 200° C.

The corrosion of an alloy ascribed to the hydrogen sulfide in such an environment as mentioned above results mainly in the cracking of the alloy under stress (stress corrosion cracking). Accordingly, alloys which are to be employed in an environment containing hydrogen sulfide should have a good resistance to stress corrosion cracking.

Known alloys which are used in an environment such as of a hydrogen sulfide-containing oil well wherein a partial pressure of hydrogen sulfide is as high as approximately 10 atm., include Ni—Cr—Mo—Fe Ni-based alloys which contain Ni in amounts as great as 30–50% (Japanese Laid-open Patent Application Nos. 57-131340, 57-134544 and 57-134545).

For instance, Japanese Laid-open Patent Application No. 57-131340 proposes an alloy which comprises, aside from Ni, Cr, Mo and W, Cu and Co, if necessary, in order to improve the resistance to stress corrosion cracking.

These alloys for oil wells are so designed as to improve the corrosion resistance to hydrogen sulfide including a resistance to stress corrosion cracking. More particularly, the corrosion resistance to hydrogen sulfide is greatly influenced by the content of hydrogen sulfide present in raw oil and the temperature of the raw oil. Accordingly, when used in such an environment of hydrogen sulfide as having set out above, the alloy is so designed that a corrosion-resistant film is formed on the surfaces of the alloy. The corrosion-resistant film should have a two-layer structure including an outer layer consisting of a Ni sulfide film and an inner layer consisting of a Cr oxide film. In order to facilitate the growth of the inner layer of the Cr oxide film, at least one of Mo and W is incorporated in the alloy. The reason why the corrosion-resistant film is designed to have a double-layer structure is so that hydrogen sulfide is prevented from entering into the inner layer by means of the outer layer of the Ni sulfide film thereby preventing the breakage of the Cr oxide inner film with the hydrogen sulfide. The Cr oxide inner film is able to suppress the dissolution of the alloy and thus, acts to improve the corrosion resistance, ensuring a good corrosion resistance to hydrogen sulfide.

However, it has been confirmed that in an environment where the partial pressure of hydrogen sulfide is relatively low at a level of about 1 atm., or below and the temperature is about 150° C., conventional alloys of the type set out above are not satisfactorily resistant to corrosion. The reason for this has now been found as follows: the Ni sulfide film serving as the outer layer which has the corrosion resistance to hydrogen sulfide is unlikely to grow under conditions where a partial pressure of hydrogen sulfide gas is low.

Moreover, since the known alloys contain both or either of Mo and W which are expensive, the resultant alloys become undesirably high in cost.

Accordingly, there is a strong demand for the development of high-Cr and high-Ni alloys which are excellent in corrosion resistance to hydrogen sulfide including a resistance to stress corrosion cracking when placed in an environment where the partial pressure of hydrogen sulfide is as low as about 1 atm., or below and the temperature is about 150° C., and which are available inexpensively.

The invention has for its object the provision of a high-Cr and high-Ni alloy which overcomes the problems involved in the prior art, which is imparted with good corrosion resistance to hydrogen sulfide under environmental conditions of a partial pressure of hydrogen sulfide of 1 atm., or below and a temperature of about 150° C., and which is low in cost.

DISCLOSURE OF THE INVENTION

The high-Cr and high-Ni alloy of the invention has a good corrosion resistance to hydrogen sulfide under environmental conditions of a partial pressure of hydrogen sulfide of 1 atm., or below and a temperature of about 150° C. The alloy is free of Mo and W which are expensive elements and is thus low in cost, and is mass-producible. The alloy of the invention has the following chemical composition on the basis of percent by weight:

Si: 0.05–1.0%
Mn: 0.1–1.5%
Cr: 20–30%
Ni: 20–40%
sol. Al: 0.01–0.3%
Cu: 0.5–5.0%
REM: 0–0.10%
Y: 0–0.20%
Mg: 0–0.10%
Ca: 0–0.10%
Balance: Fe and incidental impurities In the composition, the contents of C, P and S in the incidental impurities should, respectively, be 0.05% or below, 0.03% or below and 0.01% or below.

As defined above, REM, Y, Mg and Ca do not have to be added at all, however, if these elements are used, it is sufficient to add at least one of REM, Y, Mg and Ca. Preferable contents of these elements are as follows:

REM: 0.001–0.10%

Y: 0.001–0.20%

Mg: 0.001–0.10%

Ca: 0.001–0.10%

BEST MODE FOR CARRYING OUT THE INVENTION

In order to solve the problems in the prior art, we made extensive experiments and studies from different angles. As a result, we obtained information as set out in (1) and (2) below.

(1) In an environment where a partial pressure of hydrogen sulfide is as relatively low as about 1 atm., or below, the resistance to stress corrosion cracking of high-Cr and high-Ni alloys can be remarkably improved by incorporating an appropriate amount of Cu and optimizing the contents of Cr and Ni. In this connection, it is not necessary to use any expensive Mo and W which have been conventionally considered essential for ensuring good resistance to stress corrosion cracking.

According to the knowledge obtained by us, the improvement of the resistance to stress corrosion cracking is not satisfactorily attained by merely increasing the content of Ni. The mere increase in amount of Ni does not result in a dense outer layer made of a Ni sulfide film which is one of the protective layers having a double-layer structure and formed on the surfaces of the alloy. This permits hydrogen sulfide to enter into the alloy. If at least one of Mo and W is added to an alloy in order to promote the growth of a Cr oxide film as an inner layer, this does not lead to an improved resistance to stress corrosion cracking.

When Cu, Cr and Ni are, respectively, added in amounts defined in the present invention, the resultant alloy is improved in the resistance to stress corrosion cracking when placed in an environment where a partial pressure of hydrogen sulfide is low. The mechanism for this is assumed as follows:

Cu is more likely to form its sulfide than Ni. Under environmental conditions where a partial pressure of hydrogen sulfide is low, the Cu sulfide serves to densify the Ni sulfide film formed as the outer layer on the alloy surfaces. This is why the resistance to permeation of hydrogen sulfide is enhanced. Like Mo and W, Cu is an element which is likely to form oxides in an acidic environment. The thus formed Cu oxide densifies the inner Cr oxide film. More particularly, Cu densities both the outer Ni sulfide film and the inner Cr oxide film thereby improving the corrosion resistance of the films. Thus, it is considered that the resultant alloy is remarkably improved in the corrosion resistance to hydrogen sulfide.

(2) The Cu-containing high-Cr and high-Ni alloy is provided with adequate hot workability. The reason for this is that since the content of Ni is so high that the austenitic phase becomes stable, resulting in the reduction in amount of intermetallic compounds which cause hot brittleness. The incorporation of appropriate amounts of one or more of REM (rare earth elements), Y, Mg and Ca can further improve the hot workability.

The function and appropriate content of each of the elements comprising the alloy of the invention are described below, in which percent for each element is by weight.

Si: 0.05–1.0%

Si is an element necessary for deoxidation of molten steel at the time of refining. In order to ensure a satisfactory effect of deoxidation, the content should be 0.05% or above. However, if the content exceeds 1.0%, the hot workability worsens. Accordingly, the content of Si is in the range of 0.05–1.0%, preferably 0.2–0.5%.

Mn: 0.1–1.5%

Mn, like Si, is an element necessary for deoxidation of molten steel. In order to achieve a good deoxidation effect, the content of Mn should be 0.1% or above. However, if the content of Mn exceeds 1.5%, the hot workability becomes poor. Accordingly, the content of Mn is in the range of 0.1–1.5%, preferably 0.5–0.75%.

Cr: 20–30%

Cr is an element which is effective for improving the corrosion resistance to hydrogen sulfide (especially, resistance to stress corrosion cracking) in co-existence with other major components of Ni and N. If the content is less than 20%, such an effect cannot be obtained satisfactorily. Cr tends to worsen hot workability. If the content is reduced to a range of less than 20%, no significant effect of improving the hot workability may be obtained. On the other hand, where the content of Cr exceeds 30%, any further improvement of the corrosion resistance to hydrogen sulfide cannot be attained using a higher content of Cr within the above range. Moreover, in the case where the content of Cr exceeds 30%, good hot workability cannot be expected even if the content of S is reduced. Accordingly, the content of Cr is in the range of 20–30%, preferably 22–27%.

Ni: 20–40%

Ni is effective in improving the corrosion resistance to hydrogen sulfide. This effect is shown when the content of Ni is 20% or above. However, when the content exceeds 40%, any further effect is not expected using a higher content within the above range. Where Ni (which is expensive) is contained in amounts higher than required, the resultant alloy becomes expensive, thus being economically poor. Accordingly, the content of Ni is in the range of 20–40%, preferably 22–30%.

Sol. Al: 0.01–0.3%

Al, like Si and Mn, is an element necessary for the deoxidation of molten steel. The deoxidation effect is shown when the content of sol. Al (ie.. Al contained in alloy and soluble in hydrochloric acid) is 001% or above. However, when the content of sol. Al exceeds 0.3%, hot workability is impeded. Accordingly, the content of sol. Al is in the range of 0.01–0.3%, preferably 0.1–0.15%.

Cu: 0.5–5.0%

Cu is the most important element for the invention which constitutes a characteristic feature of the high-Cr and high-Ni alloy of the invention. Cu serves to remarkably improve the corrosion resistance to hydrogen sulfide in an environment of hydrogen sulfide gas whose partial pressure is as low as 1 atm., or below. In order to achieve this improvement, 0.5% or above of Cu should be present. However, if Cu is added in excess of 5.0%, no further improvement is expected. Additionally, when the content exceeds 5.0%, hot workability is degraded. Accordingly, the content of Cu is in the range of 0.5–5.0%, preferably 1.0–3.0%.

REM, Y, Mg and Ca:

Aside from the above-stated alloying elements, the alloy of the invention may contain one or more of REM (rare earth elements), Y, Mg and Ca in order to improve hot workability. These elements are effective in improving hot workability as in the case where the alloy is hot-worked under severe conditions.

If these elements are added, it is preferred to use 0.001–0.10% of REM, 0.001–0.20% of Y, 0.001–0.10% of Mg and 0.001–0.10% of Ca.

Where the lower limit in content of each element is less than 0.001%, any significant effect of improving the hot workability is not obtained. On the other hand, when the contents of the respective elements exceed the defined upper limits, coarse oxides are formed, thus impeding hot workability. Thus, when these elements are used, it is preferred to use the contents defined above.

Incidental impurities:

Major incidental impurities include C, P and S. Among these elements, the content of C should preferably be not more than 0.05%.

If the content of C exceeds 0.05% and Nb or V co-exist as an impurity, coarse carbide is formed along with the co-existing element, and Cr carbide is formed at grain boundaries in a contiguous state. The formation of these carbides causes Cr depletion zones, so that stress corrosion cracking is liable to occur along the grain boundaries. For this reason, the upper limit of the content of C is determined at 0.05%, and the content of C is preferably 0.03% or below.

When the content of P exceeds 0.03, the susceptibility to stress corrosion cracking in an environment of hydrogen sulfide increases. Accordingly, the upper limit is 0.03%. The content is preferably 0.02% or below.

When the content of S exceeds 0.01%, hot workability is considerably impeded. Accordingly, the content of S is defined to be not more than 0.01. If the content of S is so great, hot workability is considerably impeded as set out above. In this connection, if the content of S is as low as about 0.0007% or below, hot workability is improved. Accordingly, if good hot workability under severe conditions is essential, it is preferred to reduce the content of S to a level of 0.0007% or below.

In the alloy of the invention, the incidental impurity elements may further comprise, aside from the above-stated C, P and S, 0.10% or below of B, Sn, As, Sb, Bi, Pb and Zn. The impurities present in such amounts as set out above exerts little influence on the characteristics of the alloy of the invention.

The alloy of the invention and articles such as alloy pipes made of the alloy of the invention as a base metal can be made using manufacturing apparatus and methods which are employed for ordinary commercial manufacture. For instance, melting of the alloy may be conducted by utilizing electric furnaces, argon-oxygen decarburization furnaces (AOD furnaces), vacuum-oxygen decarburization furnaces (VOD furnaces) and the like. The molten metal may be cast into ingots or may be cast into rod-shaped billets according to a continuous casting technique. When alloy pipes are manufactured, for example, from these billets, it is preferred to use an extrusion pipe making processes such as the Ugine Sejournet process, or the Mannesman pipe making process. The pipe making conditions such as a heating temperature of billets prior to pipe making may be those of the case using conventional high-Cr and high-Ni alloys.

EXAMPLES

In order to confirm the characteristic properties of the alloys of the invention, 19 alloys indicated in Table 1 were made by melting. These alloys were each made according to a procedure wherein the respective alloys were molten in an electric furnace and, after substantial adjustment in chemical composition, were subjected to decarburization and desulfurization treatments by use of an argon-oxygen decarburization furnace (AOD furnace). The resultant molten metal was cast into an ingot having a weight of 1500 kg and a diameter of 500 mm. Among the 19 alloys indicated in Table 1, alloy Nos. 1–12 are for the invention and alloy Nos. 13–19 are for comparison.

Individual ingots having such chemical compositions as indicated in Table 1 were treated in the following manner:

Initially, each ingot was heated to 1250° C. and subjected to hot forging at 1200° C. to obtain a rod with a diameter of 150 mm. The rod was cut into pieces having a length of 1000 mm to obtain billets for extrusion pipe making. The billet was shaped into a pipe having a diameter of 60 mm, a thickness of 5 mm and a length of about 20 m according to the Ugine Sejournet hot extrusion pipe making process. Only one pipe was made for each alloy indicated in Table 1.

The resultant pipes were each subjected to solution treatment under conditions where the pipe was maintained at 1100° C. for 0.5 hours and quenched with water. Further, the pipe was cold-worked so that the yield strength (0.2% offset) was adjusted to 125 ksi grade (125–140 ksi=87.75–98.228 kgf/mm$^2$), thereby providing a product pipe.

TABLE 1

| | | Chemical Composition*1 (Weight %) | | | | | | | | | | Corrosion | Hot Work- |
|---|---|---|---|---|---|---|---|---|---|---|---|---|---|
| | No | C | Si | Mn | P | S | Cr | Ni | sol. Al | Cu | Other Elements | Resistance | ability |
| Examples of the Invention | 1 | 0.04 | 0.08 | 0.75 | 0.015 | 0.002 | 22 | 35 | 0.05 | 0.6 | — | ○ | ○ |
| | 2 | 0.03 | 0.25 | 0.86 | 0.012 | 0.001 | 20 | 30 | 0.12 | 1.5 | — | ○ | ○ |
| | 3 | 0.03 | 0.05 | 0.25 | 0.027 | 0.003 | 29 | 27 | 0.28 | 3.0 | — | ○ | ○ |
| | 4 | 0.02 | 0.56 | 0.43 | 0.015 | 0.005 | 21 | 39 | 0.23 | 2.0 | — | ○ | ○ |
| | 5 | 0.01 | 0.28 | 0.55 | 0.009 | 0.001 | 25 | 35 | 0.06 | 4.7 | Zn: 0.5 | ○ | ○ |
| | 6 | 0.02 | 0.05 | 0.85 | 0.015 | 0.001 | 21 | 30 | 0.08 | 0.8 | Y: 0.08 | ○ | ○ |
| | 7 | 0.03 | 0.95 | 0.12 | 0.025 | 0.008 | 25 | 25 | 0.02 | 1.7 | Mg: 0.075 | ○ | ○ |
| | 8 | 0.02 | 0.32 | 0.56 | 0.023 | 0.002 | 25 | 21 | 0.09 | 2.5 | Ca: 0.03 | ○ | ○ |
| | 9 | 0.02 | 0.25 | 0.95 | 0.018 | 0.001 | 20 | 35 | 0.08 | 4.3 | Y: 0.04, Mg: 0.05 | ○ | ○ |
| | 10 | 0.01 | 0.36 | 0.53 | 0.012 | 0.002 | 25 | 28 | 0.15 | 1.3 | Mg: 0.03, Ca: 0.05 | ○ | ○ |
| | 11 | 0.02 | 0.41 | 0.41 | 0.010 | 0.001 | 23 | 28 | 0.12 | 0.8 | REM: 0.01, Y: 0.02 Mg: 0.03 | ○ | ○ |
| | 12 | 0.01 | 0.52 | 0.30 | 0.009 | 0.001 | 27 | 37 | 0.10 | 2.5 | REM: 0.03, Y: 0.02 Mg: 0.01, Ca: 0.02 | ○ | ○ |
| Examples of the Comparaison | 13 | 0.03 | 0.25 | 0.56 | 0.015 | 0.002 | 18 | 35 | 0.10 | 1.5 | — | X | X |
| | 14 | 0.05 | 0.69 | 0.75 | 0.025 | 0.001 | 25 | 18 | 0.08 | 2.0 | — | X | X |
| | 15 | 0.03 | 0.56 | 0.25 | 0.020 | 0.001 | 20 | 30 | 0.15 | 0.3 | — | X | ○ |
| | 16 | 0.03 | 0.75 | 0.60 | 0.015 | 0.003 | 25 | 32 | 0.11 | 0.3 | Mo: 3.0, Mg: 0.075 | X | ○ |

TABLE 1-continued

| | Chemical Composition*1 (Weight %) | | | | | | | | | | Corrosion | Hot Work- |
|---|---|---|---|---|---|---|---|---|---|---|---|---|
| No | C | Si | Mn | P | S | Cr | Ni | sol. Al | Cu | Other Elements | Resistance | ability |
| 17 | 0.02 | 0.09 | 0.85 | 0.009 | 0.002 | 25 | 27 | 0.05 | 0.2 | Mo: 3.0, W: 1.0 Y: 0.04 | X | ○ |
| 18 | 0.01 | 0.56 | 0.52 | 0.012 | 0.001 | 23 | 30 | 0.08 | 0.3 | W: 6.0 | X | X |
| 19 | 0.01 | 0.45 | 0.55 | 0.011 | 0.001 | 25 | 38 | 0.18 | 8.0 | — | ○ | X |

*1: The balance is Fe and incidental impurities.
*2: The values with underlines show they are outside the range of the invention.

A sample piece was taken out from each pipe and subjected to a corrosion test in a hydrogen sulfide environment to check corrosion resistance to hydrogen sulfide. The corrosion test in the hydrogen sulfide environment was conducted in the following manner. It should be noted that the hot workability was evaluated in terms of the presence (symbol "x" in Table 1) or the absence (symbol "o" in Table 1) of defects through visual observation of defects on the inner surfaces of a pipe obtained by extrusion pipe making. Two sample pieces for each alloy were used for the corrosion test in the hydrogen sulfide environment.

Corrosion test method in the hydrogen sulfide environment:

Device used: autoclave

Test piece: width of 10 mm, thickness of 2 mm and length of 75 mm, with a 0.25 mm U-shaped notch (made at the center of a test piece)

Test solution: 0.5% $CH_3COOH$-20% NaCl aqueous solution

Testing atmosphere: 0.1 atm. $H_2S$-30 atm. $CO_2$

Testing temperature: 150° C.

Test piece immersion time: 720 hours

Added stress: 125 ksi (87.75 kgf/mm$^2$) (the stress was added by 10 mm at the central portion of the test piece according to a four-point supporting method.)

Observation of Corrosion (1) Pitting corrosion: visual observation of the test piece (2) Cracking: observation of the section of the U-notched portion through an optical microscope at 100× magnifications In Table 1, the results of the corrosion test in the hydrogen sulfide environment and the results of evaluation of the hot workability are shown in Table 1. With respect to the corrosion resistance to hydrogen sulfide, where either pitting corrosion or cracking was not observed at all, this resistance is indicated as "o". Where either of pitting corrosion or cracking was observed, this is indicated as "x".

As shown in Table 1, the alloys of the inventive example (alloy Nos. 1–12), wherein the chemical compositions are within the range of the invention, were not recognized with respect to the pitting corrosion and the cracking in the corrosion test in the hydrogen sulfide environment. Moreover, no defect on the inner surface of the pipes obtained after pipe making was found.

These results reveal that the alloys of the invention are excellent in the corrosion resistance to hydrogen sulfide and hot workability. Especially, where at least one element selected from REM, Y, Mg and Ca is present within a range defined in the invention, the hot workability is better than that of the case where such an element is not added at all.

Although not shown in Table 1, those alloys of the invention wherein Cu was in the range of 1.0–3.0%, Cr was in the range of 22–27% and Ni was in the range of 22–30% had a good corrosion resistance to hydrogen sulfide and good hot workability. Thus, it was found that these ranges were more preferred.

On the other hand, with the comparative alloys (alloy Nos. 13–18), wherein the chemical composition was outside the scope of the invention, either cracking or pitting corrosion took place during in the corrosion test in the hydrogen sulfide environment. Alloy No. 19 has a high Cu content, the corrosion resistance to hydrogen sulfide was not so poor. Although the Cu content was within the range of the invention, Alloy Nos. 13 and 14 were not good with respect to the corrosion resistance to hydrogen sulfide. This was because the content of Cr in alloy No. 13 and the content of Ni in alloy No. 14 were, respectively, lower than those defined in the present invention.

With alloy Nos. 13, 14, 18 and 19, defects were found on the inner surfaces of the pipes, suggesting poor hot workability. The reason why the hot workability was poor was that the balance in content between Cr and Ni was not good for alloy No. 13, Ni was so low in content that the resultant austenitic phase was unstable for alloy No. 14, the content of W was so high that an intermetallic compound was formed for alloy No. 18, and the content of Cu was outside the range for alloy No. 19.

Comparative alloy Nos. 16–18 contain either or both of Mo and W and those alloys have been hitherto accepted as showing good corrosion resistance to hydrogen sulfide in an environment where a partial pressure of hydrogen sulfide gas is high. Nevertheless, as will be apparent from this example, these alloys were poor in corrosion resistance to hydrogen sulfide. These results revealed that where the partial pressure of hydrogen sulfide gas was low, like those conditions of this example, Mo and W did not serve to improve the corrosion resistance to hydrogen sulfide.

Aside from the above example, alloy No. 2 of the invention was further subjected to another corrosion test in the hydrogen sulfide environment where a partial pressure of hydrogen gas in the testing atmosphere was set at 0.8 atm., with the other conditions being the same as in Example 1. As a result, it was found that where the partial pressure of hydrogen sulfide gas was 0.8 atm., the inventive alloy was excellent in corrosion resistance to hydrogen sulfide.

POSSIBILITY OF INDUSTRIAL UTILIZATION

The alloys of the invention exhibit an excellent corrosion resistance to hydrogen sulfide in an environment where a partial pressure of hydrogen sulfide gas is as low as about 1 atm., or below, along with good hot workability. Since it is not necessary to add Mo and W (which are expensive), the cost of raw materials for alloys making decreases. Moreover, the alloys of the invention can be made by use of manufacturing apparatus and method which have been conventionally used for the manufacture, thus making it possible to mass-produce the alloy inexpensively.

Accordingly, where the alloy of the invention is employed, for example as a material for pipes which are in contact with a hydrogen sulfide-containing corrosive fluid produced from oil wells, good corrosion resistance is ensured. The alloy of the invention thus has very high practical value for use as a material which is used in an environment where a partial pressure of hydrogen sulfide gas is relatively low.

I claim:

1. A high-Cr and high-Ni alloy having good corrosion resistance to hydrogen sulfide, the alloy consisting essentially of the following chemical composition on the basis of percent by weight:

| | |
|---|---|
| Si: 0.05–1.0%; | Mn: 0.1–1.5%; |
| Cr: 20–30%; | Ni: 20–40%; |
| sol. Al: 0.01–0.3%; | Cu: 0.5–5.0%; |

balance: Fe and incidental impurities, provided that C, P and S in the incidental impurity are, respectively, 0.05% or below, 0.03% or below and 0.01% or below.

2. A high-Cr and high-Ni alloy according to claim 1, wherein, on the basis of percent by weight, the content of Cu ranges between 1.0–3.0%.

3. A high-Cr and high-Ni alloy according to claim 1, wherein, on the basis of percent by weight, the content of Cr ranges between 22–27%.

4. A high-Cr and high-Ni alloy according to claim 1, wherein, on the basis of percent by weight, the content of Ni ranges between 22–30%.

5. A high-Cr and high-Ni alloy according to claim 1, wherein, on the basis of percent by weight, the content of Cu ranges between 1.0–3.0%, the content of Cr ranges between 22–27%, and the content of Ni ranges between 22–30%.

6. A high-Cr and high-Ni alloy according to claim 1, wherein the alloy is free of Mo and W.

7. A high-Cr and high-Ni alloy according to claim 1, wherein the Cu content of the alloy is sufficient to densify a layer of Cr oxide on an exposed surface of the alloy and densify a layer of Ni sulfide on the Cr oxide layer.

8. A high-Cr and high-Ni alloy according to claim 1, wherein the Cu is present in an amount effective to improve corrosion resistance to hydrogen sulfide in an environment of hydrogen sulfide gas having a partial pressure of 1 atm and at a temperature of 150° C.

9. A high-Cr and high-Ni alloy according to claim 1, wherein the S content is 0.0007% or below and the alloy includes 0.10% or below of each of B, Sr, As, Sb, Bi, Pb and Zn.

10. A high-Cr and high-Ni alloy having good corrosion resistance to hydrogen sulfide, the alloy consisting essentially of the following chemical composition on the basis of percent by weight:

| | |
|---|---|
| Si: 0.05–1.0%; | Mn: 0.1–1.5%; |
| Cr: 20–30%; | Ni: 20–40%; |
| sol. Al: 0.01–0.3%; | Cu: 0.5–5.0%; |

at least one of REM, Y, Mg and Ca;

| | |
|---|---|
| REM: 0.001–0.10%; | Y: 0.001–0.20%; |
| Mg: 0.001–0.10%; | Ca: 0.001–0.10%; |

provided that C, P and S in the incidental impurity are, respectively, 0.05% or below, 0.03% or below and 0.01% or below.

11. A high-Cr and high-Ni alloy according to claim 10, wherein, on the basis of percent by weight, the content of Cu ranges between 1.0–3.0%.

12. A high-Cr and high-Ni alloy according to claim 10, wherein, on the basis of percent by weight, the content of Cr ranges between 22–27%.

13. A high-Cr and high-Ni alloy according to claim 10, wherein, on the basis of percent by weight, the content of Ni ranges between 22–30%.

14. A high-Cr and high-Ni alloy according to claim 10, wherein, on the basis of percent by weight, the content of Cu ranges between 1.0–3.0%, the content of Cr ranges between 22–27%, and the content of Ni ranges between 22–30%.

15. A high-Cr and high-Ni alloy according to claim 10, wherein the alloy is free of Mo and W.

16. A high-Cr and high-Ni alloy according to claim 10, wherein the Cu content of the alloy is sufficient to densify a layer of Cr oxide on an exposed surface of the alloy and densify a layer of Ni sulfide on the Cr oxide layer.

17. A high-Cr and high-Ni alloy according to claim 10, wherein the Cu is present in an amount effective to improve corrosion resistance to hydrogen sulfide in an environment of hydrogen sulfide gas having a partial pressure of 1 atm and at a temperature of 150° C.

18. A high-Cr and high-Ni alloy according to claim 10, wherein the S content is 0.0007% or below and the alloy includes 0.10% or below of each of B, Sr, As, Sb, Bi, Pb and Zn.

* * * * *